US006189569B1

(12) United States Patent
Calhoun

(10) Patent No.: US 6,189,569 B1
(45) Date of Patent: Feb. 20, 2001

(54) FAUCET HOUSING ASSEMBLY

(75) Inventor: Keith A. Calhoun, Carmel, IN (US)

(73) Assignee: Masco Corporation of Indiana, Indianapolis, IN (US)

( * ) Notice: Under 35 U.S.C. 154(b), the term of this patent shall be extended for 0 days.

(21) Appl. No.: 09/352,811

(22) Filed: Jul. 13, 1999

(51) Int. Cl.[7] ..... E03C 1/04
(52) U.S. Cl. ..... 137/801; 137/359; 4/677
(58) Field of Search ..... 137/359, 801; 4/677

(56) References Cited

U.S. PATENT DOCUMENTS

| | | | | |
|---|---|---|---|---|
| 4,290,445 | * | 9/1981 | Turner | 137/801 X |
| 4,513,769 | * | 4/1985 | Purcell | 137/801 X |
| 5,073,991 | * | 12/1991 | Marty | 137/801 X |
| 5,165,121 | * | 11/1992 | McTargett et al. | 137/801 X |
| 5,368,071 | * | 11/1994 | Hsieh | 137/801 X |
| 5,746,244 | * | 5/1998 | Woolley et al. | 137/801 X |
| 5,960,490 | * | 10/1999 | Pitsch | 137/801 X |

* cited by examiner

*Primary Examiner*—Gerald A. Michalsky
(74) *Attorney, Agent, or Firm*—Myron B. Kapustij; Lloyd D. Doigan

(57) ABSTRACT

The faucet housing assembly comprises an escutcheon and an undercover plate. The undercover plate fits into the undersurface of the escutcheon forming a snap-fit engagement, there being no need for any fasteners between the undercover plate and the escutcheon. The escutcheon is secured onto a faucet with fasteners and the undercover plate is assembled into the undersurface of the escutcheon. The base section of the undercover plate includes an opening disposed on each side. A strut abuts the outside edge of each opening. Each strut engages one of a pair of mounting posts extending downward from the undersurface of the escutcheon. An arcuate lip extends from the center arched section of the undercover plate, the arcuate lip being positioned about a spout outlet. The arcuate lip forms an abutting engagement against a pair of rib members positioned about the aerator on the undersurface of the escutcheon, the rib members compressing the arcuate lip. This compression securely retains the arched center section of the undercover plate to the undersurface of the escutcheon when the base section of the undercover plate is secured against the mounting posts. The faucet housing assembly with faucet is pre-assembled and shipped as a unit.

15 Claims, 3 Drawing Sheets

FAUCET HOUSING ASSEMBLY

FIELD OF ART

Figure 1:
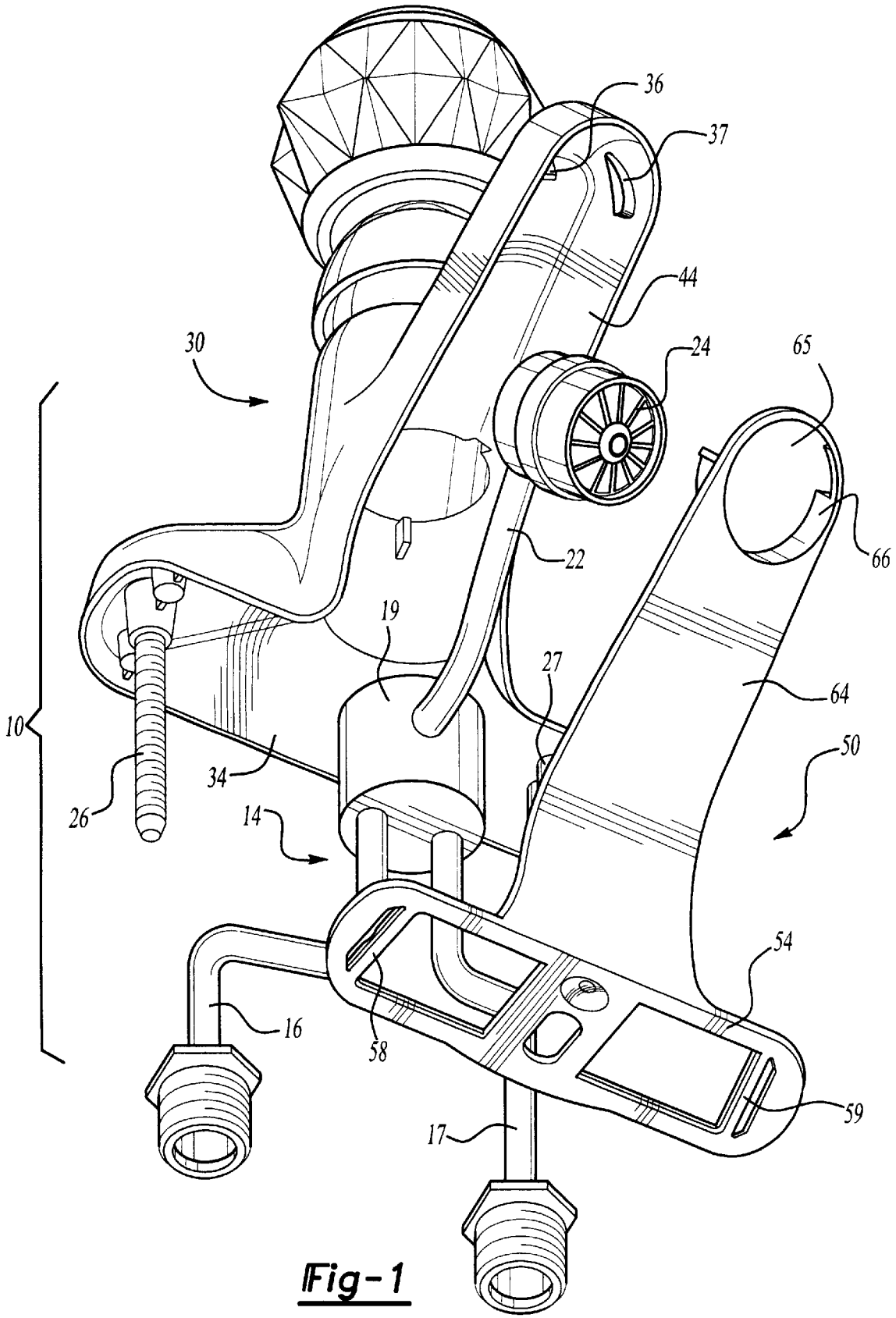

This invention relates to a unique faucet housing assembly, and more particularly, to the escutcheon and an undercover plate of the faucet housing assembly and the engagement therebetween.

BACKGROUND OF THE INVENTION

Faucet housing assemblies having an undercover plate secured to the undersurface of an escutcheon are used in a variety of configurations, as shown in the following:

U.S. Pat. No. 4,084,607 (Fagert et al.) and U.S. Pat. No. 5,165,121 (McTargett et al.) each disclose a faucet assembly that includes a first undercover plate adapted to fit the undersurface of the spout portion of the escutcheon and a second undercover plate designed to fit the undersurface of the base portion of the escutcheon. A plurality of bosses ensures secure retention therewith.

U.S. Pat. No. 5,368,071 (Hsieh) discloses a washbasin faucet assembly comprising a valve housing, a ceramic valve, a casing, a base frame, and an operating handle. The base frame is positioned beneath the valve housing, and the area connecting the base frame to the casing is sealed when mounted.

U.S. Pat. No. 5,642,755 (Mark et al.) discloses a faucet assembly that includes a throat plate mounted on the undersurface of the throat and escutcheon. The portion of the throat plate that engages the undersurface of the throat includes a pair of bosses for cooperative engagement with a pair of bosses in the throat for secure retention therewith.

U.S. Pat. No. 5,797,151 (Ko) discloses a plurality of embodiments of various faucet assemblies, each comprising a housing, a discharge pipe, a filter cap, a knob, a tap body, a base plate and means to secure the discharge pipe to the tap body. The unit is assembled at the time of installation and is then mounted onto the sink.

However, these designs either require no assembly prior to shipping or require additional fasteners to secure the undercover plate to the escutcheon prior to shipping.

What is needed is a simplified construction for a faucet housing assembly that includes an escutcheon and a one-piece undercover plate, the undercover plate replacing much of the underbody of the escutcheon and enabling secure retention beneath the undersurface of the escutcheon.

What is needed is a simplified construction for a faucet housing assembly that includes an escutcheon and undercover plate, that enables secure retention between the escutcheon and the undercover plate without the need for any fasteners therebetween during assembly, prior to shipping, or prior to installation of the faucet housing assembly.

SUMMARY OF THE INVENTION

All of the above needs are met by the faucet housing assembly of the present invention. The faucet housing assembly includes an escutcheon, an undercover plate, and cooperative engagement means between the escutcheon and the undercover plate.

The base section of the undercover plate has the same general shape as the undersurface of the escutcheon. The base section of the undercover plate has a pair of openings disposed therein, one on each side of the base section. A strut abuts the outside edge of each opening. An edge of each strut enables a snap-fit engagement between the base section and a pair of mounting posts extending from the undersurface of the escutcheon.

The arched center section of the undercover plate includes an arcuate lip extending upward therefrom. The arched center section has a shape generally the same as the undersurface of the fluid discharge section of the escutcheon. The base section of the undercover plate has a snap-fit engagement with the undersurface of the mounting section of the escutcheon.

The cooperative engagement means between the escutcheon and the undercover plate is preferably a snap-fit engagement. This snap-fit engagement is preferably achieved by cooperative engagement between (1) the base section of the undercover plate and the undersurface of the mounting section of the escutcheon, and (2) the arched center section of the undercover plate and the fluid discharge section undersurface of the escutcheon. This dual engagement makes fasteners between the undercover plate and the escutcheon unnecessary (a) during shipping and (b) during and after installation.

When the undercover plate is secured to the escutcheon, the arcuate lip of the undercover plate abuts the two rib members of the escutcheon compressing the arcuate lip against the two rib members.

For a more complete understanding of the faucet housing assembly of the present invention, reference is made to the following detailed description and accompanying drawings in which the presently preferred embodiment of the invention is shown by way of example. As the invention may be embodied in many forms without departing from the spirit of essential characteristics thereof, it is expressly understood that the drawings are for purposes of illustration and description only, and are not intended as a definition of the limits of the invention.

DETAILED DESCRIPTION OF THE DRAWINGS

Figure 2:
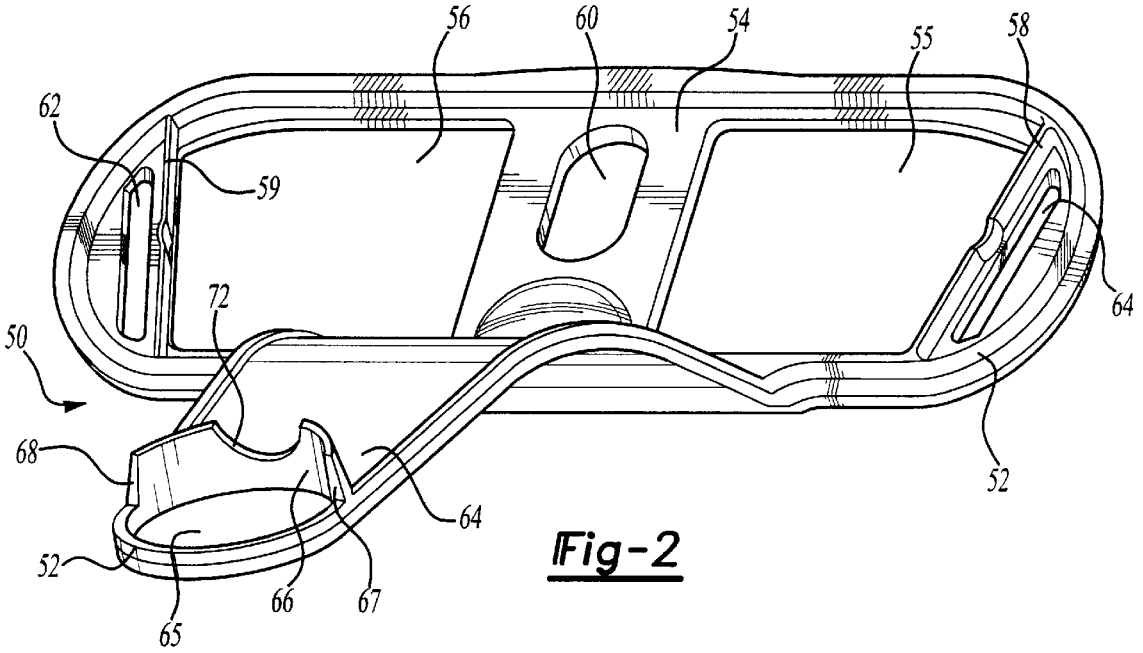
Figure 3:
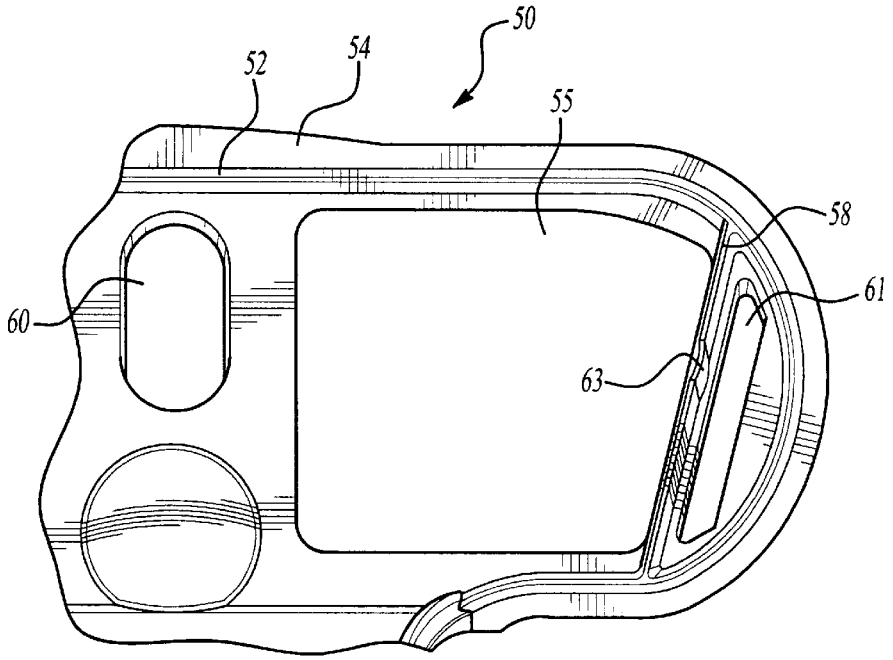
Figure 4:
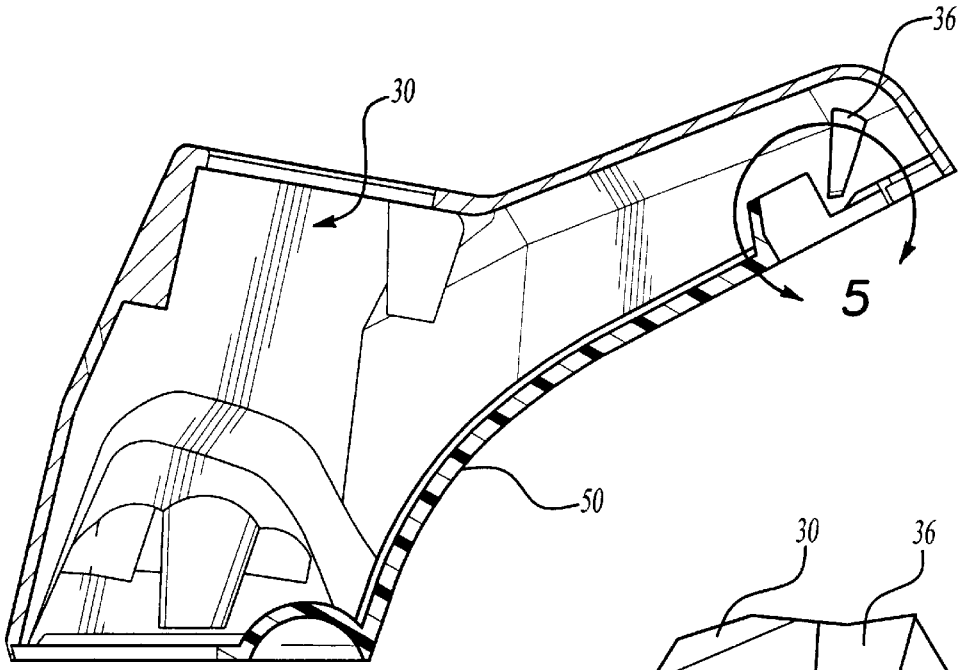
Figure 5:
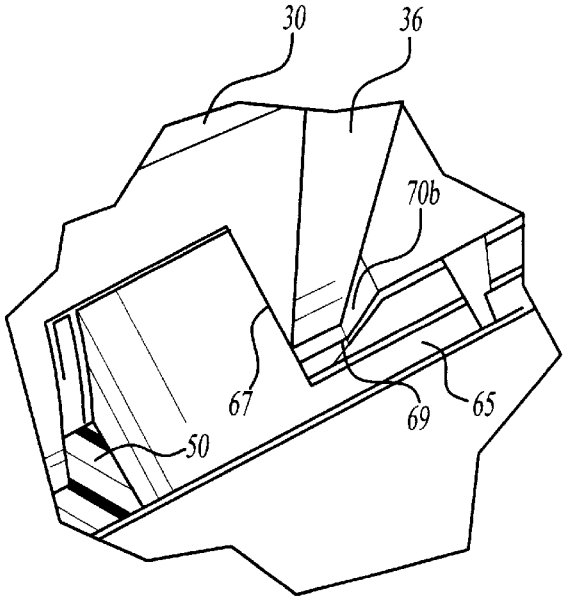
Figure 6:
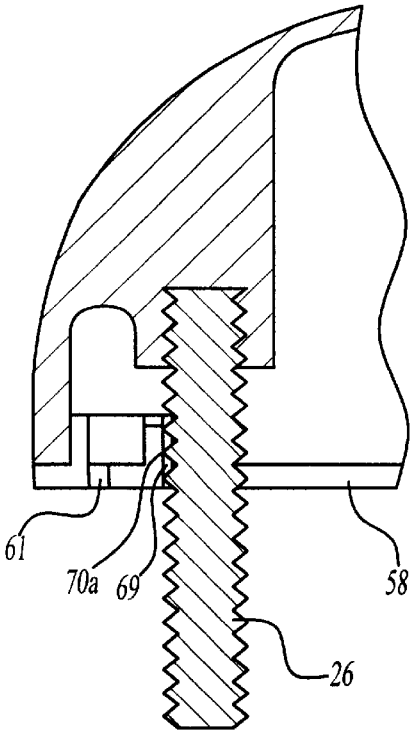

FIG. 1 discloses an assembly view of the preferred embodiment of the faucet housing assembly of the present invention as viewed looking upward into the undercover plate, the faucet, and the escutcheon;

FIG. 2 discloses an isometric top view of the preferred embodiment of the undercover plate shown in FIG. 1;

FIG. 3 discloses an exploded top view of a partial section of the base section of the undercover plate shown in FIG. 2;

FIG. 4 discloses an end view of the escutcheon and the undercover plate of FIG. 1;

FIG. 5 discloses a detailed end view of the engagement between a rib member of the escutcheon and the arcuate lip of the undercover plate of FIG. 4; and FIG. 6 discloses a sectional side view of the engagement between a threaded mounting post extending downward from the undersurface of the escutcheon with a strut of the undercover plate of the faucet housing assembly of FIG. 1.

DETAILED DESCRIPTION OF THE PREFERRED EMBODIMENT

FIG. 1 discloses the faucet housing assembly 10 of the present invention, which includes an escutcheon 30, an undercover plate 50, and cooperative engagement means 70*a* and 70*b* between the escutcheon 30 and the undercover plate 50.

The undersurface of the escutcheon 30 includes a pair of mounting posts 26 and 27 extending downward therefrom, each mounting post preferably being threaded. A faucet 14 is positioned within the faucet housing assembly 10 of the present invention between the escutcheon 30 and the undercover plate 50. The faucet 14 comprises hot and cold water inlets 16 and 17, a faucet valve 19, a spout tube 22, and an aerator 24. The hot and cold water inlets 16 and 17 feed into the spout tube 22 and the water is discharged through the aerator 24. The escutcheon 30 is secured onto the faucet 14 with fasteners (not shown) and the undercover plate 50 is assembled into the undersurface of the escutcheon 30 as hereinafter set forth. The housing 10 and faucet 14 are then preferably sold and subsequently affixed onto a conventional sink as a unit.

The preferred embodiment of the undercover plate 50 of the present invention is shown in FIG. 2. The undercover plate 50 has a one-piece construction and comprises a base section 54 and an arched center section 64. The undercover plate 50 is preferably made of fifteen percent glass-reinforced polypropylene. The base section 54 is generally flat, having essentially parallel inboard and outboard edges with rounded ends. About the perimeter of the undercover plate 50 is a rim 52 that extends in an upward direction toward the escutcheon 30. When the undercover plate 50 is in cooperative engagement with the escutcheon 30, the rim 52 fits inside the undersurface of the escutcheon 30. The rim 52 is useful during assembly for alignment purposes.

FIG. 3 discloses an exploded top view of a partial section of the base section 54 of the undercover plate 50. The base section 54 includes a pair of openings 55 and 56, symmetrically positioned, one on each side thereof. A water inlet and a mounting post are positionable within each opening. Secure retention is achieved by means of an interference fit between the base section 54 of the undercover plate 50 and the pair of mounting posts 26 and 27 extending within each of the respective openings 55 and 56. The pair of slits 61 and 62 are each large enough to provide increased elasticity of the undercover plate 50 for deflection of the struts 58 and 59 relative to the mounting posts 26 and 27 and the edges 67 and 68 of the arcuate lip 66 relative to the rib members 36 and 37. However, the pair of slits 61 and 62 are each smaller than the fluid inlets 16 and 17 to prevent inadvertent placement of either inlet therethrough during assembly.

The arched center section 64 of the undercover plate 50 also has a similar slope as the fluid discharge section 44 to enable nesting therewith. The arched center section 64 of the undercover plate 50 includes a spout opening 65 and an arcuate lip 66 surrounding the inboard half of the spout opening 65 and extending upward therefrom. The arcuate lip 66 prevents water from running down the inside surface of the undercover plate 50. The arcuate lip 66 includes a notch 72, the lip notch 72 being centrally disposed and extending from the edge of the arcuate lip 66 upward almost to the surface of the arched center section 64. The lip notch 72 provides clearance for the spout tube 22, which feeds the aerator 24.

The base section 54 of the undercover plate 50 has a snap-fit engagement with the undersurface of the mounting section 34 of the escutcheon 30. A pair of struts 58 and 59 abuts the outside edge of each of the openings 55 and 56, one strut alongside each opening. The struts 58 and 59 are each tapered so as to converge in the inboard direction of the base section 54 of the undercover plate 50. A pair of slits 61 and 62 are positioned between the perimeter of the base section 54 and each of the struts 58 and 59. The strut notches 63 are positioned at the point of engagement with the threaded mounting posts 26 and 27 to further ensure a secure engagement therewith and prevent relative movement once nested. The slits 61 and 62 provide clearance for lateral movement of each of the struts 58 and 59. Each of the struts 58 and 59 has a small notch 63 positioned about midway thereon. When the struts 58 and 59 are in cooperative engagement with the mounting posts 26 and 27, both of the mounting posts 26 and 27 are centered within a strut notch 63, and each strut is stretched into a slit 61 and 62.

The escutcheon 30 has a mounting section 34 and a fluid discharge section 44. To ensure a snug nesting engagement between the undercover plate 50 and the undersurface of the escutcheon 30, (a) the base section 54 of the undercover plate 50 has a shape generally the same as the shape of the undersurface of the mounting section 34 of the escutcheon 30; and (b) the arched center section 64 of the undercover plate 50 has the same general shape as the undersurface of the fluid discharge section 44 of the escutcheon 30.

The cooperative engagement means 70 between the escutcheon 30 and the undercover plate 50 is a snap-fit engagement. This snap-fit engagement is achieved by (1) cooperative engagement 70*a* between the base section of the undercover plate 50 and the undersurface of the mounting section of the escutcheon 30, and (2) cooperative engagement 70*b* between the arched center section 64 of the undercover plate 50 and the undersurface of the fluid discharge section 44 of the escutcheon 30. The escutcheon 30 includes two rib members 36 and 37 positioned about the aerator. The rib members 36 and 37 oppose each other. When the undercover plate 50 is secured to the escutcheon 30, the arcuate lip 66 of the undercover plate 50 abuts the rib members 36 and 37 of the escutcheon 30 compressing the arcuate lip 66 against the rib members 36 and 37. This compression ensures snap-fit engagement of the undercover plate 50 to the escutcheon 30.

FIG. 4 discloses an end view of the escutcheon 30 in cooperative engagement with the undercover plate 50, and FIG. 5 shows an exploded view of the engagement between the arcuate lip 66 and the rib members 36 and 37. For purposes of clarity, no fluid outlet is shown in FIGS. 4 and 5. The arcuate lip 66 of the undercover plate 50 is wedged about the spout and the base section 54 of the undercover plate 50 is pinned against the mounting posts 26 and 27 in the faucet assembly 10 of the present invention. This retention secures the undercover plate 50 to the undersurface of the faucet assembly 10 during shipping and installation. When the faucet is mounted to the sink, additional fasteners cooperatively engage the mounting posts 26 and 27.

The escutcheon 30 includes two rib members 36 and 37 positioned about the aerator 24 and integral with the undersurface of escutcheon 30, the rib members 36 and 37 opposing each other. There is a slight recess 69 on each side of the arcuate lip 66 where the side edges 67 and 68 of the arcuate lip 66 join the arched center section 64. The arcuate lip 66 abuts the two rib members 36 and 37 of the escutcheon 30, the tip of each of the rib members 36 and 37 nesting within the recess 69, thereby compressing the arcuate lip 66. This compression securely retains the arched center section 64 to the undersurface of the fluid discharge section 44 of the escutcheon 30 when the base section 54 of the undercover plate 50 has a snap-fit engagement against the mounting posts 26.

To install the undercover plate 50 to the escutcheon 30, the fluid inlets 16 and 17 and the mounting posts 26 and 27 are first positioned within each of the respective openings 55 and 56 in the undercover plate 50. Then, as the arched center section 64 meets the undersurface of the fluid discharge section 44 of the escutcheon 30, the two rib members 36 and 37 hook into the edges 67 and 68 of the arcuate lip 66. The base section 54 is then moved into direct contact with the undersurface of the mounting section 34 of the escutcheon 30. Once contact occurs, the strut notches 63 of the undercover plate 50 form the snap-fit engagement with the threaded mounting posts 26 and 27, as shown in FIG. 6. Once assembled, the arcuate lip 66 is compressed against the rib members 36 and 37. This engagement securely retains the arched center section 64 against the fluid discharge section 44 when the base section 54 of the undercover plate 30 is in snap-fit engagement with the undersurface of the escutcheon 30, thereby making fasteners unnecessary prior to installation.

The patents referred to in this specification are for background purposes only, the complete specifications and drawings of which are incorporated herein by reference.

It is evident that many alternatives, modifications, and variations of the faucet housing assembly of the present invention will be apparent to those skilled in the art in light of the disclosure herein. It is intended that the metes and bounds of the present invention be determined by the appended claims rather than by the language of the above specification, and that all such alternatives, modifications, and variations which form a conjointly cooperative equivalent are intended to be included within the spirit and scope of these claims.

What is claimed:

1. An undercover plate for engagement with an escutcheon and mounting posts, the escutcheon having a mounting section and a fluid discharge section, the mounting section and the fluid discharge section each having an undersurface, an aerator extending downward from the fluid discharge section, the undercover plate comprising:

a base section having the same general shape as the undersurface of the mounting section of the escutcheon;

an arched center section having the same general shape as the undersurface of the fluid discharge section of the escutcheon, the arched center section of the undercover plate being securely retained against the fluid discharge section undersurface of the escutcheon and the base section of the undercover plate being securely retained against the mounting section undersurface of the escutcheon; and cooperative engagement means between the undercover plate and the undersurface of the escutcheon enabling snap-fit engagement therebetween without fasteners, said means comprising a spout opening and an arcuate lip, the arcuate lip surrounding at least part of the spout opening and extending upward from said arched center section, the arcuate lip providing a cooperative engagement with the undersurface of the escutcheon.

2. The undercover plate of claim 1, further comprising a pair of openings disposed in the base section, a strut abutting each opening, an edge of each strut enabling a snap-fit engagement between the base section and the mounting posts.

3. The undercover plate of claim 2 wherein said arcuate lip cooperatively engages a plurality of rib members disposed about the aerator to securely retain the arched center section to the fluid discharge section undersurface.

4. The undercover plate of claim 3, wherein the arcuate lip has a compressed engagement against two rib members when the base section is engaged against the mounting posts, the rib members abutting the aerator and opposing each other.

5. The undercover plate of claim 3, wherein the arcuate lip surrounds at least a lower half of the spout opening, the arcuate lip preventing water from running down the inside surface of the undercover plate after assembly.

6. An undercover plate for engagement with an escutcheon and mounting posts, the escutcheon having a mounting section and a fluid discharge section, the mounting section and the fluid discharge section each having an undersurface, an aerator extending downward from the fluid discharge section, the undercover plate comprising:

a base section including a pair of struts and a pair of openings, one strut abutting each opening, an edge of each strut enabling a cooperative engagement between the base section and the pair of mounting posts;

an arched center section having a spout opening, an arcuate lip surrounding at least part of the spout opening, the arcuate lip extending upward from the arched center section, the arcuate lip abutting the undersurface of the escutcheon to securely retain the arched center section to the undersurface of the escutcheon, the arched center section being retained against the undersurface of the escutcheon when the base section is in cooperative engagement with the undersurface of the mounting section; and snap-fit retainment means between the base section of the undercover plate and the undersurface of the mounting section of the escutcheon, the arched center section of the undercover plate being securely retained against the fluid discharge section of the undersurface of the escutcheon and the base section of the undercover plate being securely retained against the mounting section undersurface of the escutcheon, the engagement between the undersurface of the escutcheon making fasteners unnecessary between the undercover plate and the escutcheon.

7. The undercover plate of claim 6, wherein the base section of the undercover plate has the same general shape as the undersurface of the escutcheon and the arched center section of the undercover plate has the same general shape as the undersurface of the fluid discharge section of the escutcheon.

8. The undercover plate of claim 6, wherein the arcuate lip has a compressed engagement against two rib members when the base section is engaged against the mounting posts to securely retain the arched center section to the fluid discharge section undersurface, the rib members abutting the aerator and opposing each other.

9. The undercover plate of claim 6, wherein the arcuate lip surrounds at least a lower half of the spout opening, the arcuate lip preventing water from running down the inside surface of the undercover plate after assembly.

10. A faucet housing assembly comprising: an escutcheon having a mounting section and a fluid discharge section, the mounting section and the fluid discharge section each having an undersurface, an aerator being disposed on the undersurface of the fluid discharge section, a pair of mounting posts extending from the undersurface of the escutcheon; an undercover plate having a base section and an arched center section, the base section of the undercover plate having the same general shape as the undersurface of the escutcheon and the arched center section of the undercover plate having the same general shape as the undersurface of the fluid discharge section of the escutcheon; and snap-fit retainment means between the base section of the undercover plate and the undersurface of the mounting section of the escutcheon, the arched center section of the undercover plate being securely retained against the fluid discharge section of the undersurface of the escutcheon and the base section of the undercover plate being securely retained against the mounting section undersurface of the escutcheon, the engagement between the undercover plate and the undersurface of the escutcheon being accomplished by snap-fit engagement without fasteners.

11. The faucet housing assembly of claim 10, further comprising an arcuate lip extending upward from the arched center section, the arcuate lip abutting the undersurface of the escutcheon to securely retain the arched center section to the mounting posts.

12. The faucet housing assembly of claim 10, further comprising a pair of openings disposed in the base section, a strut abutting each opening, an edge of each strut enabling a snap-fit engagement between the base section and the pair of mounting posts.

13. The faucet housing assembly of claim 10, further comprising an arcuate lip extending upward from the arched center section, the arcuate lip abutting a spout opening in the arched center section of the undercover plate.

14. The faucet housing assembly of claim 13, further comprising a pair of rib members abutting the aerator, the rib members and the aerator being disposed on the undersurface of the escutcheon, the rib members opposing each other relative to the aerator, the arcuate lip being compressed against the rib members when the base section is securely retained against the mounting posts.

15. The faucet housing assembly of claim 10, wherein the arcuate lip surrounds at least a lower half of the spout opening, the arcuate lip preventing water from running down the inside surface of the undercover plate after assembly.

* * * * *